US011806764B2

(12) United States Patent
Soemoto et al.

(10) Patent No.: US 11,806,764 B2
(45) Date of Patent: Nov. 7, 2023

(54) CLEANER HEAD

(71) Applicant: TAKUSYO CO., LTD., Takatsuki (JP)

(72) Inventors: Kazuhiko Soemoto, Osaka (JP); Hiroshi Uzawa, Izumi (JP)

(73) Assignee: TAKUSYO CO., LTD., Takatsuki (JP)

( * ) Notice: Subject to any disclaimer, the term of this patent is extended or adjusted under 35 U.S.C. 154(b) by 471 days.

(21) Appl. No.: 17/073,809

(22) Filed: Oct. 19, 2020

(65) Prior Publication Data

US 2022/0062954 A1 Mar. 3, 2022

(30) Foreign Application Priority Data

Sep. 3, 2020 (JP) ..... 2020-148335

(51) Int. Cl.
*B08B 5/02* (2006.01)
*B08B 15/04* (2006.01)

(52) U.S. Cl.
CPC ..... *B08B 5/02* (2013.01); *B08B 15/04* (2013.01)

(58) Field of Classification Search
CPC ..... B08B 5/02–5/026; B08B 5/04–5/046
See application file for complete search history.

(56) References Cited

FOREIGN PATENT DOCUMENTS

JP 2011-045867 A 3/2011

OTHER PUBLICATIONS

JP2011045867A (machine translation) (Year: 2011).*

* cited by examiner

*Primary Examiner* — Andrew A Horton
(74) *Attorney, Agent, or Firm* — Kratz, Quintos & Hanson, LLP

(57) ABSTRACT

A cleaner head having a discharging slit 6 on the center and sucking slits 7 on left and right on a corresponding wall portion 15 facing a dust-removed face 10, and, outer extended lines $L_7$ of the pair of sucking slits 7 are inclined as to mutually come close and intersect as departed from the corresponding wall portion 15.

1 Claim, 7 Drawing Sheets

CLEANER HEAD

1. FIELD OF THE INVENTION

This invention relates to a cleaner head.

2. DESCRIPTION OF THE RELATED ART

A conventional cleaner head $C_0$ of a cross-sectional configuration as shown in FIG. 6 is used (refer to Japanese Patent Provisional Publication No. 2011-45867).

That is to say, as shown in FIG. 6 and FIG. 7C, a dust-removed body 51 fed in an arrow K direction is a flat sheet, a flat panel, etc., a discharging slit 53 on a center and sucking slits 54 on an upstream and downstream sides in the feeding direction (the arrow K) are provided, and an interval dimension $W_{54}$ of the sucking slits 54 is set to be sufficiently large.

And, the dust-removed body 51 shown in FIG. 7B and FIG. 7C is a film (sheet body) supported by a backup roll 55 and fed in the arrow K direction, and a corresponding face 56 of the cleaner head $C_0$ is formed into a concave face of a low trapezoid or arc to keep the interval dimension between the sucking slit 54 and the dust-removed body 51 under a predetermined value.

As described above, in the conventional cleaner head $C_0$, various cleaner heads, having the corresponding face 56 appropriate for each of the configurations of the dust-removed faces of the dust-removed body 51, are necessary.

Therefore, the inventors of the present invention had an idea that the interval dimension $W_{54}$ in the conventional cleaner head $C_0$ composed of an extruded section of aluminum as shown in FIG. 6 be shortened, and considered a cleaner head $C_1$ (as a comparison example) shown in FIG. 8.

That is to say, the inventors thought that the interval dimension $W_{54}$ of the sucking slits 54 can be reduced (in comparison with FIG. 6) as shown in the comparison example in FIG. 8, and the cleaner can be applied to the dust-removed body 51 such as a sheet body supported by the backup roll 55.

However, it was revealed that the interval dimension $W_{54}$ can't be sufficiently small because the cleaner head $C_1$ is composed of an extruded section of aluminum in FIG. 8 (comparison example).

Concretely, in FIG. 8, a pressurized space 59 on the center and left and right vacuum spaces 60 are formed by a rectangular surrounding wall 57 and two bent dividing walls 58 within the surrounding wall 57, and, it is difficult to make an interval dimension Wa of a near discharging portion 59A of the pressurized space 59 near the discharging slit 53 small as shown in FIG. 8.

The reason is the difficulty of making a part of a core of an extrusion die thin as to form the small interval dimension Wa shown in FIG. 8. That is to say, when the part of the core of the extrusion die is formed thin as the interval dimension Wa, the core is damaged and abraded early in extrusion.

Further, the interval dimension Wa in FIG. 8 can't be made sufficiently small because the thickness of the extruded dividing wall 58 itself is difficult to be thin.

Therefore, it is an object of the present invention to provide a cleaner head which can be commonly used for dust-removed bodies of which dust-removed faces are straight and arc-convex in cross section.

BRIEF DESCRIPTION OF THE DRAWINGS

The present invention will be described with reference to the accompanying drawings, in which.

DESCRIPTION OF THE PREFERRED EMBODIMENTS

Preferred embodiments of the present invention will now be described with reference to the accompanying drawings.

Figure 2:
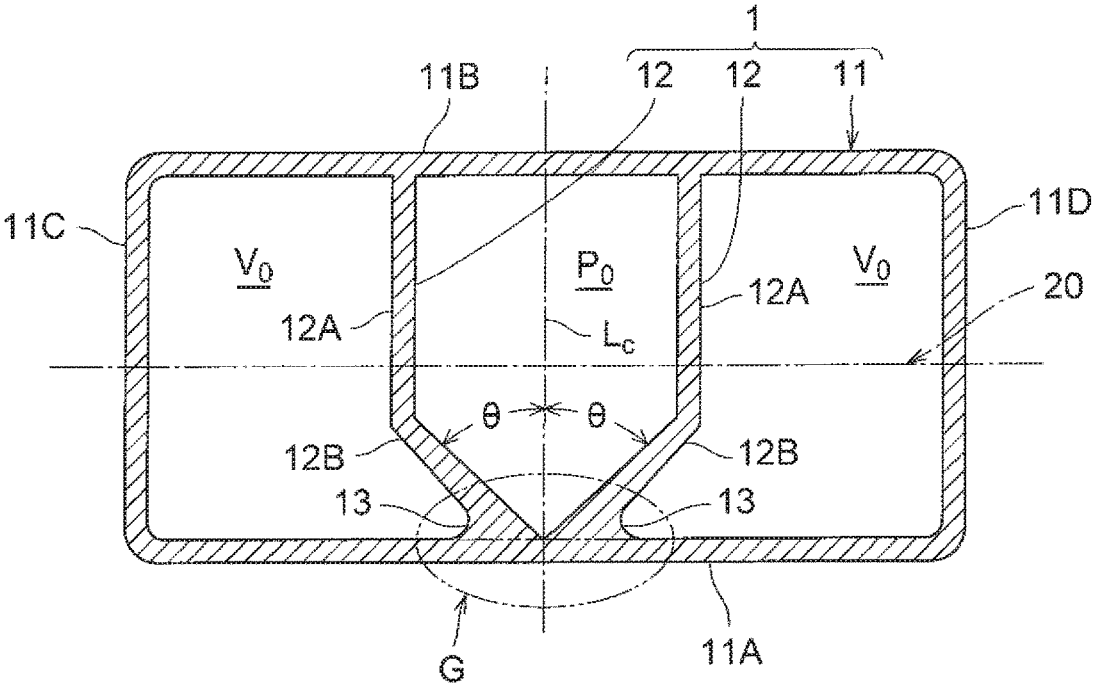
FIG. 2 is a cross-sectional view showing an extruded section before a discharging slit and sucking slits are worked.

In FIG. 2, an extruded section 1 composed of metal such as aluminum is shown. The extruded section 1 has a surrounding outer wall portion 11 rectangular in cross section and a pair of dividing inner wall portions 12 as one unit.

Figure 1:
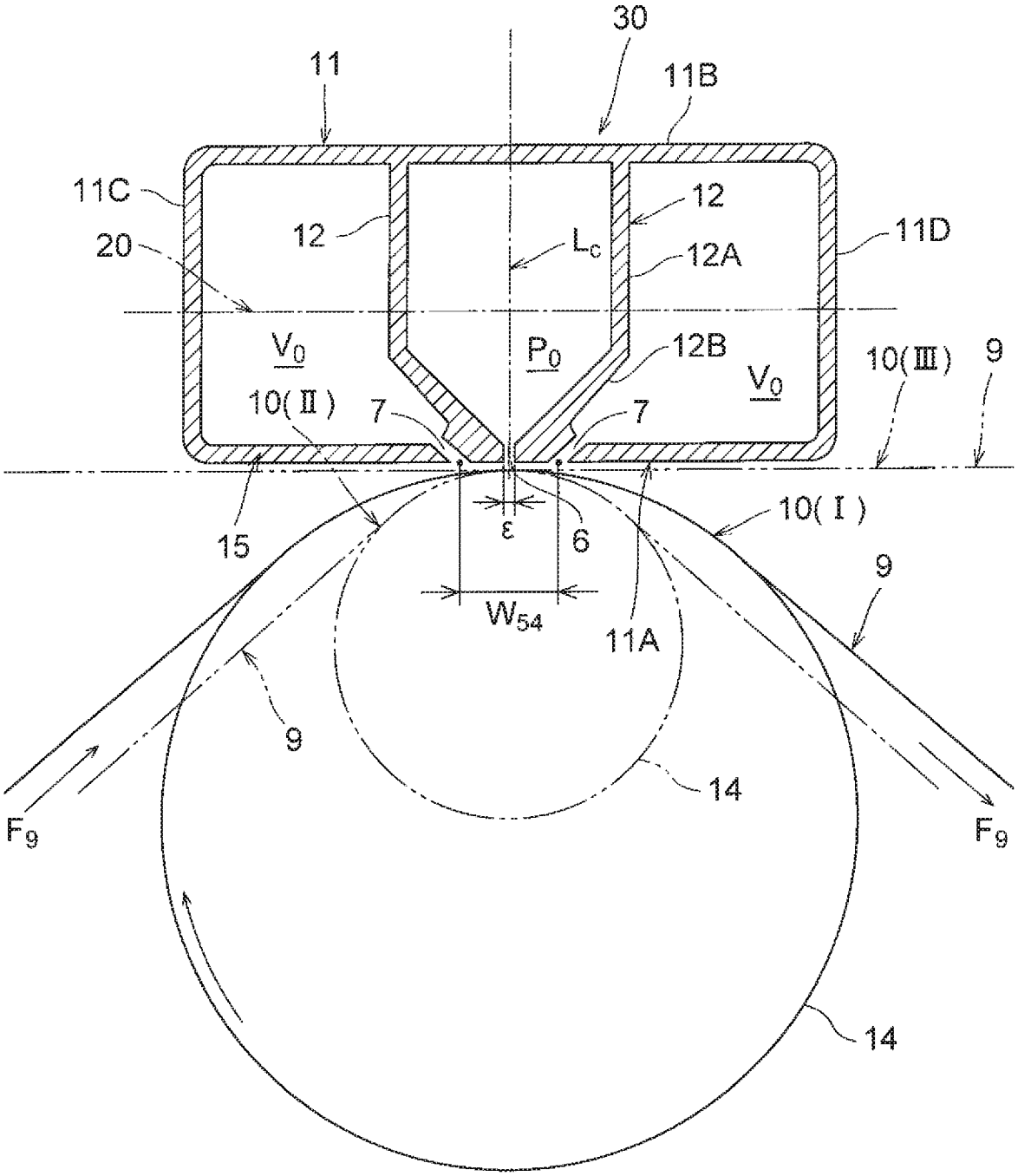
FIG. 1 is a cross-sectional view showing an embodiment of the present invention to explain a used state.
Figure 3:
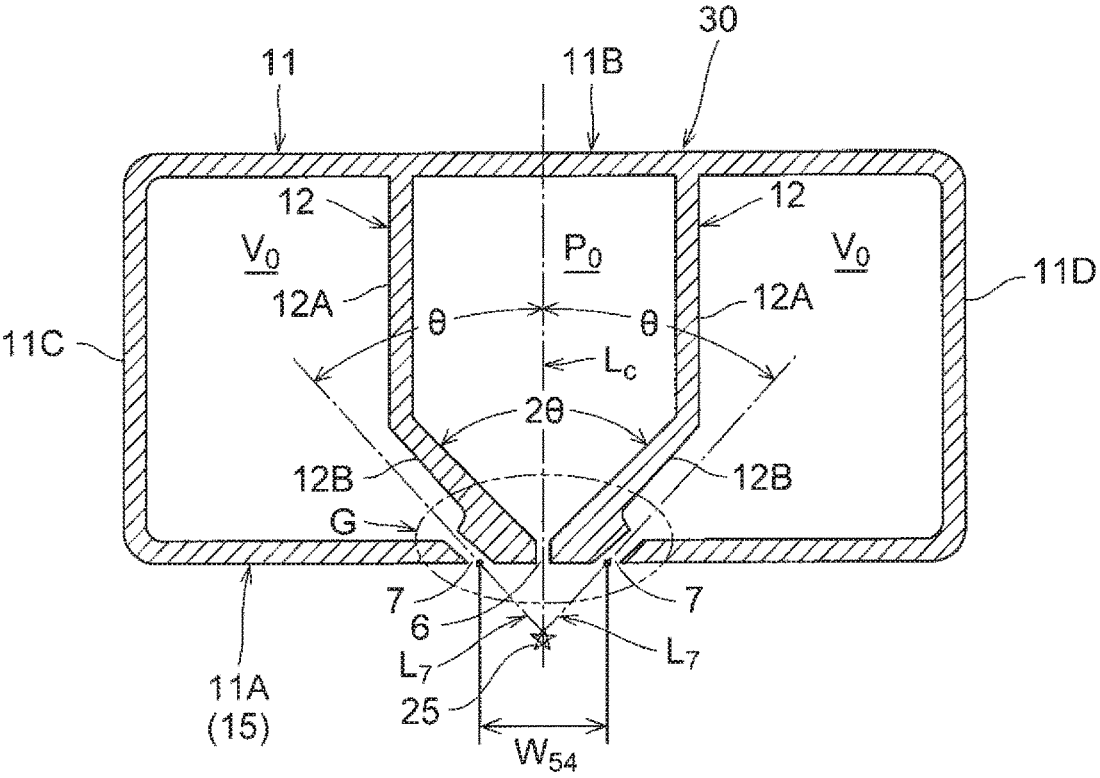
FIG. 3 is a cross sectional view for explanation in which dimensions are indicated.

In FIG. 1 and FIG. 3, a cleaner head 30 relating to the present invention is shown. The cleaner head 30 is made by opening a discharging slit 6 and two sucking slits 7 on the extruded section 1 in FIG. 2 by machine work, etc. The pair of dividing inner wall portions 12 divides an inner space of the rectangular surrounding outer wall portion 11 into a pressurized space $P_0$ and vacuum spaces $V_0$.

As described above, in FIG. 1 through FIG. 3, the inner space is divided into the pressurized space $P_0$ on the center and the left and right vacuum spaces $V_0$ by the dividing inner wall portions 12.

The surrounding outer wall portion 11 of which cross-sectional configuration is laterally long flat rectangular composed of a side (first horizontal face portion) 11A disposed to face the dust-removed face 10, another side (second horizontal face portion) 11B parallel to the side 11A, a left side (vertical left face portion) 11C, and a right side (vertical right face portion) 11D.

And, the dividing inner wall portion 12 has a vertical portion 12A and an inclined portion 12B of which cross-sectional configuration is bent "L" shaped. As shown in FIG. 2, two vertical portions 12A are suspended from the other side (upper side) 115 with right angles, and the inclined portions 12B are bent from a vertically middle position as to come close each other.

An angle θ formed by the inclined portion 12B and a central vertical line Le is 30° to 50°. The angle θ is preferably 35° to 45°.

To describe further, the pair of left and right dividing inner wall portions 12 has a cross-sectional configuration in which the dividing inner wall portions 12 are (mutually) approaching from the vertically middle position as to form a predetermined angle 2 θ of 60° to 100° (preferably 70° to 90°), and, confluent with and connected to the side (first horizontal face portion) 11A. A mark G indicates a confluent position where the inclined portions 12B of the pair of the left and right dividing inner wall portions 12 and the side (first horizontal face portion) 11A are connected.

As shown in FIG. 2, an R-shaped thick portion 13 is formed on a corner portion formed by the inclined portion 12B and the side 11A.

On the above-described confluent position G, the discharging slit 6 to jet high-pressured air in the pressurized space $P_0$ is opened. That is to say, the discharging slit 6 of narrow width dimension is formed along the central vertical line Lc.

Figure 4:
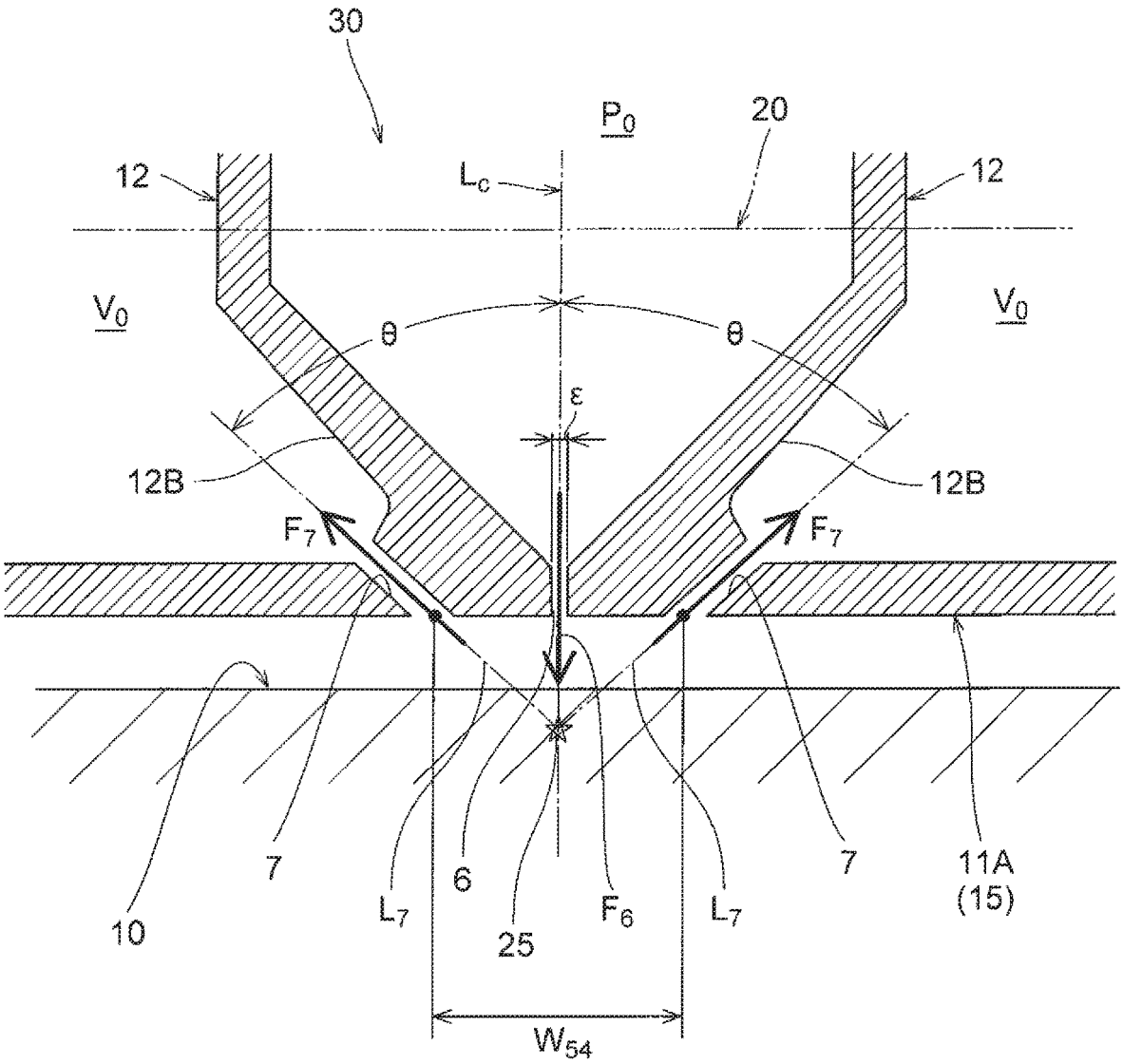
FIG. 4 is a cross-sectional view of an enlarged principal portion in used state.

And, as shown in FIG. 4 and FIG. 3, a pair of the sucking slits 7 to suck the air (after dust removing including dust separated and removed from the dust-removed face 10) into the vacuum spaces $V_c$ is formed parallel to each of the inclined portions 12B of the pair of dividing inner wall portions 12 mutually approaching with the predetermined angle 2 θ.

That is to say, each of the sucking slits 7 is opening parallel to the inclined portion 12B. Therefore, the angle formed by the pair of sucking slits 7 is 2 θ. And, the sucking slits 7 are disposed line symmetric each other with respect to the central vertical line Lc.

To explain the construction of the present invention again with another expression, the above-described side (first horizontal face portion) 11A can be called a corresponding wall portion 15 facing the dust-removed face 10.

And, as shown in FIG. 4, in the cleaner head 30 having the discharging slit 6 opening in the direction at right angles with the corresponding wall portion 15 and the pair of sucking slits 7 opening near the upstream side and the downstream side of the discharging slit 6, outer extended lines $L_7$, of the pair of sucking slits 7 opening on the corresponding wall portion 15 are inclined against the corresponding wall portion 15 as to mutually come close and intersect as departed from the corresponding wall portion 15.

As shown in FIG. 4, the outer extended lines $L_7$ are lines along the center of the slit width of each of the sucking slits 7, mutually come close with the angle of 2 θ and intersect on a position of an asterisk (in FIG. 4).

In the present invention, as shown in FIG. 4, suction flows $F_7$ are generated on positions very near an area where a discharge flow $F_6$ hits the dust-removed face 10, and the suction flows $F_7$ are very stable.

Figure 5:
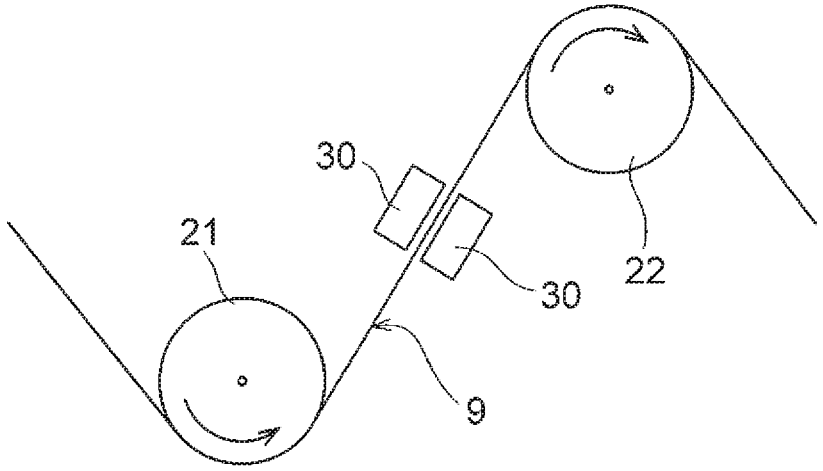
FIG. 5 is a schematic view to explain a method of use of the present invention.
Figure 6:
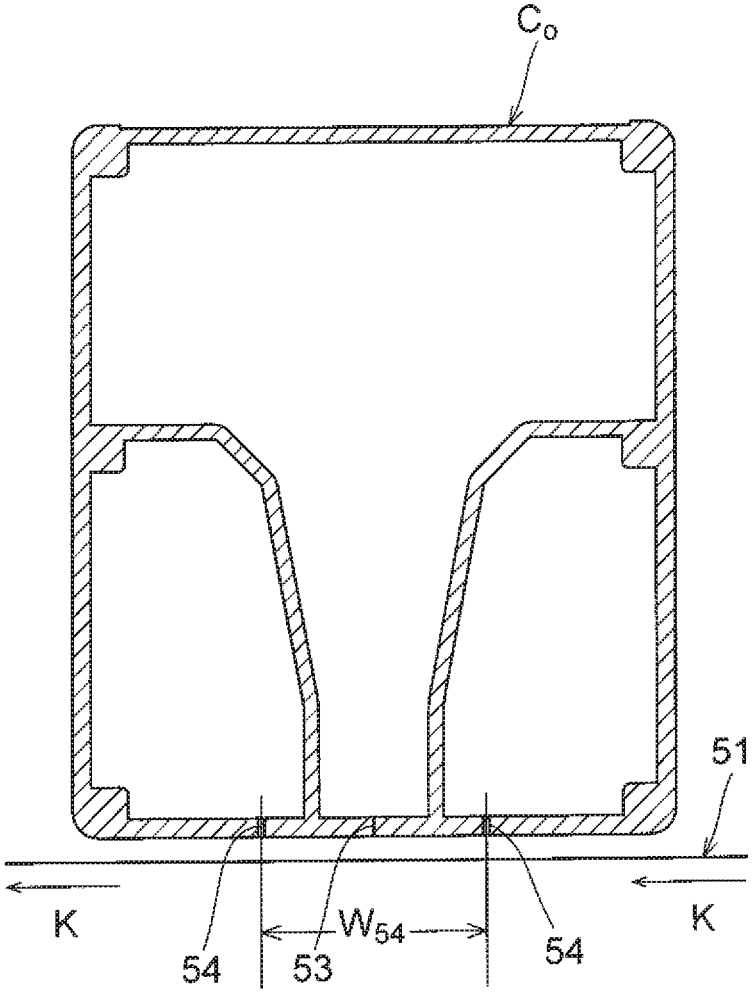
FIG.6 PRIOR ART
FIG. 6 is a cross-sectional view showing a conventional example.

Especially, the sucking slits 7 are inclined and the interval dimension $W_{64}$ of the opening ends of the sucking slits 7 can be sufficiently small, and the discharge flow $F_6$ comes close to the hitting area on the dust-removed face 10 further. Therefore, as shown in FIG. 5, the dust-removed body 9 such as a sheet body (film) can be dust-removed with a pair of the cleaner heads 30 on a middle position between feed rolls 21 and 22 without the backup roll 14 (as shown in FIG. 3). That is to say, there is also an advantage that air conveyance is possible without the backup roll 14 as shown in FIG. 5.

As shown in FIG. 1, even in a case that the dust-removed body 9 is a sheet body (film) fed by the backup roll 14 in a direction of an arrow $F_9$, the gap (interval) with the lower face of the side 11A of the surrounding outer wall portion 11 is sufficiently small on the position of the downward opening portion of the sucking slit 7.

That is to say, comparing the dust-removed face 10 (II) and the dust-removed face 10 (III), on the position of the downward opening portion of the sucking slit 7, the gap (interval) with the lower face of the side 11A of the surrounding outer wall portion 11 hardly generates difference, and sucking force through the sucking slit 7 is not different.

Figure 7A:
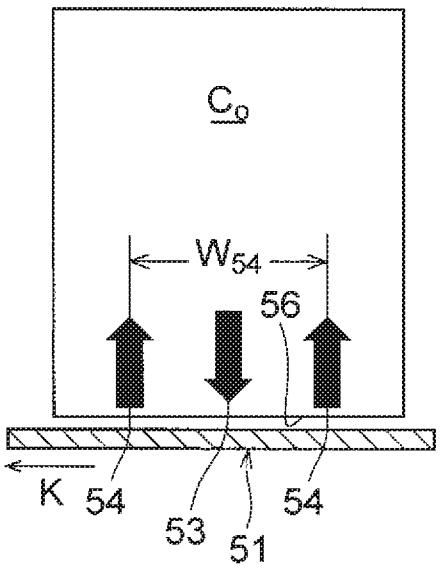
FIG.7A PRIOR ART
FIG. 7A is a schematic explanatory view showing a conventional example.
Figure 7B:
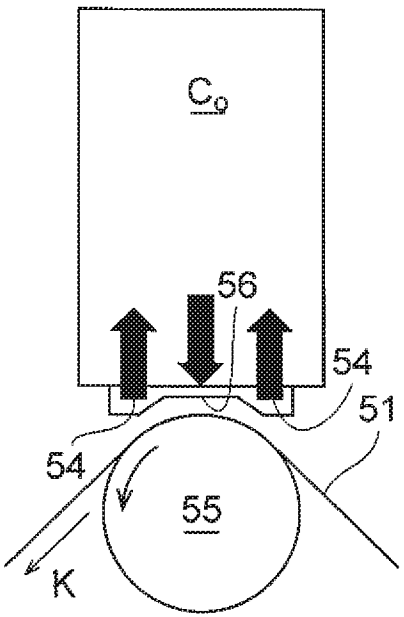
FIG.7B PRIOR ART
FIG. 7B is a schematic explanatory view showing a conventional example.
Figure 7C:
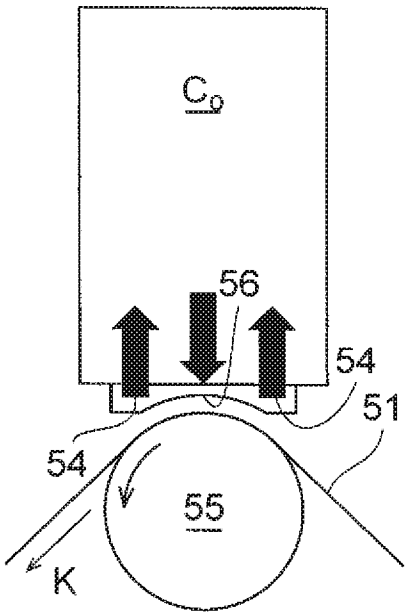
FIG.7C PRIOR ART
FIG. 7C is a schematic explanatory view showing a conventional example.

Therefore, when the dust-removed face 10 is any of (I), (IT), and (III), the cleaner head 30 of the present invention can be applied (commonly used). On the contrary, in FIGS. 7B and 7C showing conventional examples, the corresponding face 56 must be concave low trapezoid or concave arc because the sucking slits 54 have to be prevented from being separated greatly from the dust-removed body 51.

In short, the cleaner head 30 of the present invention, in which the conventional corresponding face 56 of concave low trapezoid (refer to FIG. 7B) or concave arc (refer to FIG. 7C) is not necessary, can be commonly used with the same configuration (dust-removing function can be sufficiently shown).

The present invention, as described above in detail, can correspond with flexibility to the dust-removed face 10 of the dust-removed body 9 of (flat) plane and curved faces of large and small radiuses of curvature with the sufficiently small interval dimension $W_{54}$ of the opening ends of the sucking slits 7 because in the cleaner head having the discharging slit 6 opening in the direction at right angles with the corresponding wall portion 15 facing the dust-removed face 10, and the pair of sucking slits 7 opening near upstream and downstream of the discharging slit 6, the outer extended lines $L_7$ of the pair of sucking slits 7 opening on the corresponding wall portion 15 are inclined against the corresponding wall portion 15 as to mutually come close and intersect as departed from the corresponding wall portion 15. Therefore, it is not necessary to prepare various cleaner heads.

Figure 8:
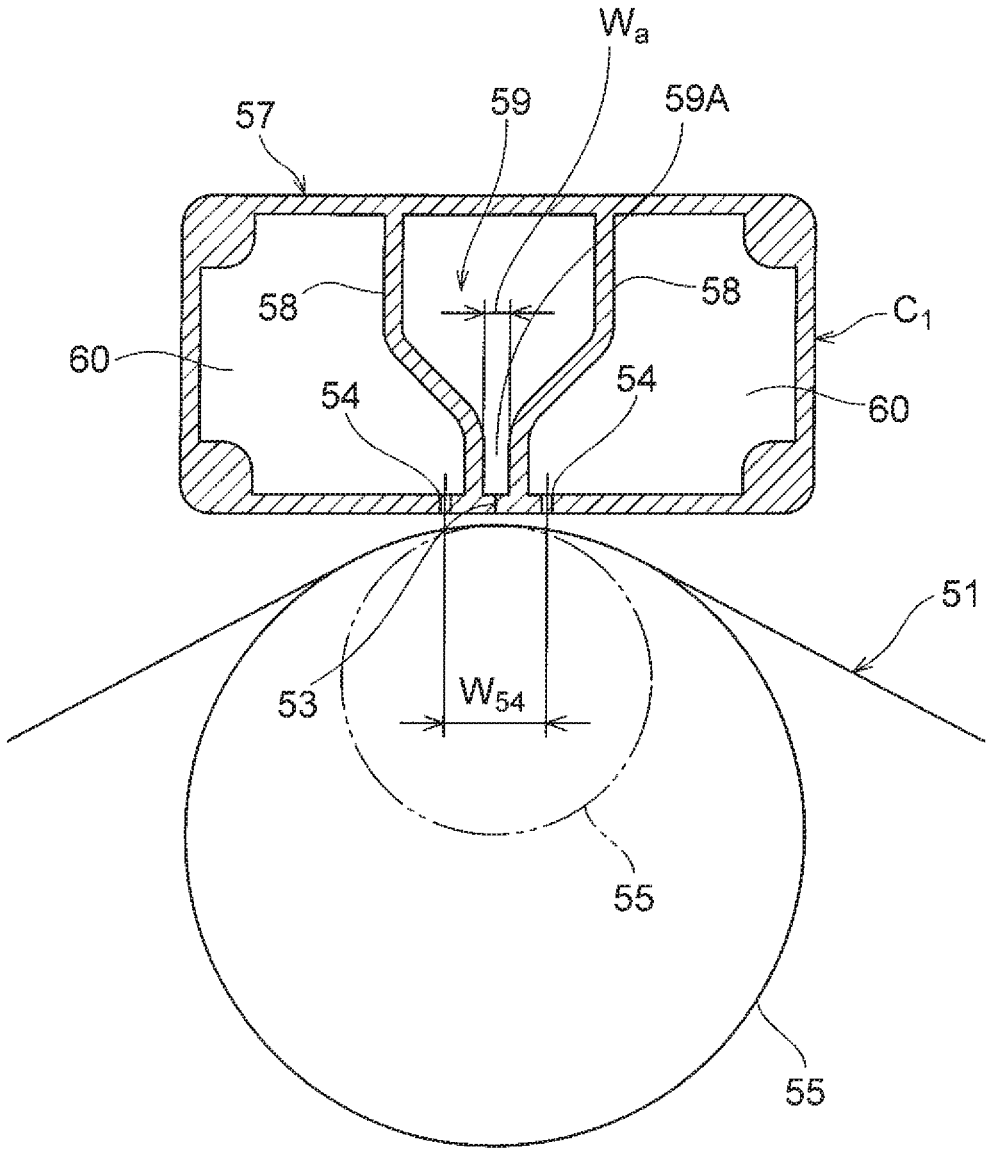
FIG. 8 is a cross-sectional explanatory view showing a comparison example.

And, the cross-sectional configuration of the pair of dividing inner wall portions 12 does not form the narrow interval dimension Wa in the comparison example in FIG. 8, the problem of damage and early abrasion of the core of the extrusion die described with FIG. 8 can be solved, and, in spite of that, the interval dimension $W_{54}$ of the opening ends of the sucking slits 7 can be made sufficiently small because the cleaner head of the present invention is made of the extruded section 1, having the surrounding outer wall portion 11 and the pair of dividing inner wall portions 12 dividing the inner space of the surrounding outer wall portion 11 into the pressurized space $P_0$ and vacuum spaces $V_0$ as one unit, the surrounding outer wall portion 11, in cross-sectional configuration, has the side 11A disposed to face the dust-removed face 10, the dividing inner wall portions 12 are mutually approaching to form the predetermined angle 2 θ of 60° to 100° and confluent with and connected to the side 11A, on the connected confluent position G, the discharging slit 6 to jet high-pressured air in the pressurized space $P_0$ is opened, further, the pair of sucking slits 7 to suck the air after dust removing into the vacuum spaces $V_0$ is formed parallel to each of the pair of dividing inner wall portions 12 mutually approaching with the predetermined angle 2 θ.

As described above, the interval dimension $W_{54}$ is sufficiently small, and the cleaner head can correspond with flexibility to the dust-removed face 10 of the dust-removed body 9 of (flat) plane and curved faces of large and small radiuses of curvature. Therefore, it is not necessary to prepare various cleaner heads.

Further, when 2 θ<60°, the interval dimension $W_{54}$ can't be sufficiently reduced, and sufficient dust removing is difficult depending on the configuration of the dust-removed face 10 (refer to FIG. 1 and its description).

And, when 2 θ>100°, the sucking area on the dust-removed face 10 is excessively small, and sufficient removal (sucking) of the dust is difficult.

While preferred embodiments of the present invention have been described in this specification, it is to be understood that the invention is illustrative and not restrictive, because various changes are possible within the spirit and indispensable features.

What is claimed is:

1. A cleaner head made of an extruded section, having a surrounding outer wall portion and a pair of dividing inner wall portions dividing an inner space of the surrounding outer wall portion into a pressurized space and vacuum spaces as one unit, comprising a construction in which:

the surrounding outer wall portion, in cross-sectional configuration, has a side disposed to face a dust-removed face;

the dividing inner wall portions are mutually approaching to form a predetermined angle of 60° to 100° and confluent with and connected to the side;

on a connected confluent position, a discharging slit to jet high-pressured air in the pressurized space is opened, further, a pair of sucking slits to suck the air after dust removing into the vacuum spaces is formed parallel to each of the pair of dividing inner wall portions mutually approaching with the predetermined angle, and outer extended lines of the sucking slits are intersecting at a predetermined position.

* * * * *